United States Patent [19]

Peyronnet

[11] Patent Number: 4,726,204

[45] Date of Patent: Feb. 23, 1988

[54] KEY-LESS COMBINATION CYLINDER LOCK, AND A COMBINATION-CHANGING TOOL

[75] Inventor: Jacques Peyronnet, Paris, France

[73] Assignee: Minilock S.A., Lausanne, France

[21] Appl. No.: 827,955

[22] Filed: Feb. 7, 1986

[30] Foreign Application Priority Data

Feb. 8, 1985 [FR] France ..... 85 01804

[51] Int. Cl.[4] ..... E05B 37/00

[52] U.S. Cl. ..... 70/315; 70/302; 70/286; 70/311

[58] Field of Search ..... 70/315-319, 70/365-366, 302, 301, 303 R, 303 A, 219, 286-288, 311, 291-293

[56] References Cited

U.S. PATENT DOCUMENTS

| | | | |
|---|---|---|---|
| 81,430 | 8/1868 | Sullivan | 70/318 |
| 300,868 | 6/1884 | Hill | 70/303 R |
| 552,277 | 12/1895 | Coxe | 70/318 |
| 712,084 | 10/1902 | Nadeau | 70/317 |
| 839,795 | 12/1906 | Wilcox | 70/318 |
| 940,762 | 11/1909 | Whalen | 70/25 |
| 1,579,046 | 3/1926 | Wildrick | 70/317 |
| 1,816,575 | 7/1931 | Full | 70/219 |
| 1,837,219 | 12/1931 | Hope | 70/315 |
| 2,766,606 | 10/1956 | Whitehead | 70/303 A |
| 3,052,114 | 9/1962 | Foote et al. | 70/315 |
| 3,611,761 | 10/1971 | Atkinson | 70/315 |
| 3,691,328 | 9/1972 | Davidson | 70/315 |
| 4,127,995 | 12/1978 | Miller | 70/303 R |
| 4,170,886 | 10/1979 | Cowen | 70/302 |
| 4,341,101 | 7/1982 | Bako | 70/318 |
| 4,350,030 | 9/1982 | Bromley | 70/70 |
| 4,370,875 | 2/1983 | Piiroinen | 70/366 |
| 4,554,809 | 11/1985 | Yang | 70/316 |

FOREIGN PATENT DOCUMENTS

| | | | |
|---|---|---|---|
| 0088012 | 7/1983 | European Pat. Off. . | |
| 28656 | 2/1884 | Fed. Rep. of Germany . | |
| 2522352 | 2/1983 | France . | |
| 2129045 | 5/1984 | United Kingdom | 70/365 |

*Primary Examiner*—Robert L. Wolfe
*Assistant Examiner*—Suzanne L. Dino
*Attorney, Agent, or Firm*—Gifford, Groh, VanOphem, Sheridan, Sprinkle and Dolgorukov

[57] ABSTRACT

A combination cylinder lock having coding elements constituted by the combination of outer rings having notches suitable for receiving a locking member disposed between a rotor and a stator, in combination with coding disks having drive members enabling the combination to be decoded. The outer rings and the corresponding central disks are mutually declutchable in order to enble automatic combination changing.

19 Claims, 4 Drawing Figures

200
201
202
251
252
253
260
261
263
264
250
170
173
174
175
176
160
220
60
52
50
51
53
40
42
41
43
44
45
90
70
71
72
76
77
78
80
10
15
17
18
19
100
101
102
181
182
180
190
126A
124A
121A
122A
123A
120A
125A
123B
121B
126B
124B
120B
125B
142
141
140
143
126C
124C
121C
123C
120C
280
282
284
281
283
300
301
302
303
304

KEY-LESS COMBINATION CYLINDER LOCK, AND A COMBINATION-CHANGING TOOL

The present invention relates to a key-less combination lock, and more precisely to a key-less combination cylinder lock.

BACKGROUND OF THE INVENTION

More particularly still, the present invention seeks to improve the lock described and shown in European patent application No. 83 400 367.5 filed Feb. 22nd, 1983, by the corporation Initial Sarl, and published under the No. 0 088 012.

Reference can usefully be made to said prior published European patent specification No. 0 088 012 for a full understanding of the present invention.

The cylinder lock described in said prior European application comprises:

a stator;

a rotor surrounded by said stator;

a latch associated with said rotor;

at least one locking member disposed between said rotor and said stator, said locking member being suitable for being displaced between a locking position in which it prevents rotation of said rotor relative to said stator, and a release position in which it allows such rotation;

a plurality of coaxial coding elements, each coding element having a notch in its periphery suitable for receiving said locking member in its release position, and also having drive member suitable for rotating each of said coding elements when one of the coding elements immediately adjacent thereto is itself rotated; and a rotary element-decoding member suitable for rotating one of said elements and for enabling said notches to be brought into alignment.

In order to change the combination of the lock described in said European published patent application No. 0 088 012, it is necessary to open the lock and disassemble its various coding elements in order to modify the relative positions of the notches and the drive members of each element.

This kind of disassembly is tedious and difficult, and can only be performed by specialists who have full knowledge of the structure and the operation of the lock.

This constraint has limited the development of locks such as described in said European patent specification No. 0 088 012.

SUMMARY OF THE INVENTION

The present invention provides a lock of the type specified above and including the improvements whereby:

each coding element is constituted by the combination of an outer ring having said notch suitable for receiving said locking member and a central disk having said drive members, the inside peripheral surfaces of said rings and the outside peripheral surfaces of said central disks being suitable for enabling said disks and said rings to be mutually assembled in a multiplicity of predetermined relative angular positions;

spacers are provided between said coding elements, and said outer ring and said central disk of each coding element are capable of relative displacement in an axial direction; and said lock additionally includes a declutching member suitable for declutching said outer rings and said central disks of said coding elements by relative axial displacement thereof while said outer rings are prevented from rotating by a retaining member, thereby enabling said central disks to be rotated relative to said outer rings by actuating said rotary decoding member, and thus changing the combination of the lock.

As explained in detail below, the rotary decoding member can be actuated without disassembling the lock to automatically change the combination of the lock by changing the relative positions between the outer rings and the central disks while they are declutched from one another in the manner provided by the invention, thereby changing the relative positions of the drive members and the notches for receiving the locking member.

U.S. Pat. No. 4,350,030 (Bromley R. L.) relates to a suitcase lock comprising:

a central cylindrical rod;

a control drum rotatably mounted on the rod;

a control sleeve mounted free to rotate on the rod and constrained to rotate with the drum;

two central disks mounted to rotate on said rod;

drive pegs provided on the control sleeve and the central disks to cause each of these elements to rotate when one of the immediately adjacent elements is rotated by the drum being actuated;

three outer rings prevented from moving in translation in the body of the lock and adapted respectively to engage said control sleeve and said central disks in a multiplicity of predetermined angular positions by virtue of teeth;

a declutching member which, when displaced in translation parallel to the rod axis towards the drum, declutches the outer rings relative to the control sleeve and the central disks to enable the combination of the lock to be changed by actuating the drum and modifying the angular positions of the outer rings relative to the control sleeve and the central disks; and a helical spring urging the central disks and the control drum in engagement with the outer rings.

In order to avoid the risk of unwanted rotation of the coding members (the coding disks and the outer rings) due to friction while the lock is in use or while its combination is being changed, it is essential, according to said U.S. Pat. No. 4,350,030 to provide a leaf spring acting on the peripheries of each of the outer rings and the outer peripheries of the control sleeve and the central disks to brake free rotation thereof.

The leaf spring required in the structure proposed by said U.S. Pat. No. 4,350,030 increases the cost of the lock while also reducing its reliability.

Such a lock ceases to operate if ever the leaf spring stops providing effective braking of the various coding elements which then start to drive one another by friction.

Further, the coding elements described and shown in U.S. Pat. No. 4,350,030 are not constituted by the combination of a central disk and an outer ring whose respective outside and inside peripheral faces are adapted to be assembled together.

According to U.S. Pat. No. 4,350,030, the coding elements are constituted by juxtaposing the outer rings with the control sleeve or the disks.

These elements do not co-operate via their peripheral surfaces, but by means of respective axially extending triangular teeth fixed to the control sleeve and to the disks, which teeth engage in complementary grooves opening out into the side surfaces of the outer rings, rather than into their peripheral surfaces.

Consequently, when the drum rotates, and if the leaf spring provides too much friction braking on the outer rings, the triangular teeth may escape from the grooves provided in the outer rings, by compressing the helical spring and without rotating said rings.

The person skilled in the art will readily understand that in practise it is very difficult, or even impossible, to make such a leaf spring.

The problem is that it must be both sufficiently stiff to brake the outer rings effecively so as to avoid unintentional rotary drive of said rings by friction, while also being sufficiently compliant to avoid forcing the control teeth out from their complementary grooves when the drum is actuated.

Further, the lock described in U.S. Pat. No. 4,350,030 is very sensitive to frost. Once any trace of damp has entered the lock, subsequent freezing will cause the leaf spring to stick to the outer rings, thereby causing the control teeth to escape from their complementary grooves when the drum is actuated, and thus irretrievably changing the lock combination just as though the leaf spring were too stiff.

The present invention eliminates these various drawbacks, firstly by means of the spacers, and secondly by the complementary engagement of the inside and outside peripheral surfaces of the outer rings and the central disks making up each coding element.

In the presently preferred embodiment of the present invention, the lock includes a passage suitable for enabling a retaining member to be inserted into said lock, said retaining member being suitable for engaging said outer rings to prevent rotation thereof prior to declutching said central disks and said outer rings.

In an advantageous embodiment, said declutching member comprises a rod suitable for axial displacement within said lock by virtue of said central disks being provide with respective central bores, with said disks being free to rotate relative to said rod while being prevented from axial displacement relative thereto.

The axial positions of said disks along said rod are fixed by at least first ones of said spacers engaging said rod between said disks in such a manner as to be caused to rotate with said rod.

In a particular embodiment, said first spacers are in the shape of stepped rings, with portions thereof of smaller cross section being engaged in said central bores through said central disks and constituting rotary bearings therefor, and with portions thereof of greater cross section preventing relative axial displacement between said central disks and said rod.

Said rod, said first spacers, and said central disks then constitute a subassembly in which all the parts of the subassembly are prevented from relative axial displacement, and in which only said central disks are free to rotate relative to the subassembly.

In accordance with an optional feature of the presnet invention, said rotor defines a generally cylindrical housing in which said outer rings of said coding elements are engaged in such a manner as to be free to rotate while being prevented from relative axial displacement.

Preferably, said passage suitable for enabling an outer ring retaining member to be inserted into said lock is provided through said rotor.

Also preferably, said outer rings are prevented from relative axial displacement within said rotor by means of second ones of said spacers disposed between adjacent outer rings and constrained to rotate with said rotor.

Said rotor, said outer rings of said coding elements, and said second ones of said spacers associated with said outer rings then constitute a subassembly, all the parts of which are constrained to move together in the axial direction and in which only said outer rings of said coding elements are free to rotate.

Advantageously, said declutching member comprises a rod suitable for axial displacement within said lock and the axial thicknesses of said spacers are greater than the axial thicknesses of said of said outer rings and of said central disks of said coding elements, and at least slightly greater than the stroke of said rod in axial translation.

In a first variant embodiment, said declutching member comprises a rod suitable for axial displacement within said lock, and said rod has a through slot for receiving a pin engaged in said rotor, thereby preventing said rod from rotating relative to said rotor and limiting its axial sliding stroke relative thereto.

In a second variant embodiment said declutching member comprises a rod suitable for axial displacement within said lock, and said rod has two transverse bores each of which is suitable for receiving a removable pin engaged in said rotor, thereby constraining said rod to rotate with said rotor and defining two axial positions of said rod relative to said rotor, said positions corresponding to said outer rings and said central disks of said coding elements being enclutched and being declutched, respectively.

In a third variant embodiment said declutching member comprises a rod of polygonal cross section which is free to move axially in a complementary hole provided in said rotor, but is not free to rotate relative thereto. Said hole is a half-blind hole to limit the body of the rod towards the back of the lock, and said half-blind hole terminates with a tapped hole of smaller section opening out to the back of the rotor to pass a screw (e.g. a removable screw) which pushes or pulls the rod to provide its axial declutching displacement.

Said rotary decoding member is advantageously axially displaceable to rotate said rotor and to open said lock when said notches in said outer rings are in alignment.

In the presently preferred embodiment of the invention, said rotary decoding member is constituted by a cylinder having sliding teeth suitable for engaging said rotor in order to rotate said rotor when said notches are in alignment.

Said rotary decoding member is advantageously disposed on the front face of said stator and possesses structures suitable for co-operating in driving relationship with a dial, said dial and said stator including graduations and reference point capable of indicating the relative angular position of said dial and said stator.

According to another optional feature of the invention providing a simple and compact lock, a spring is disposed between said rotary decoding member and said declutching member to initially separate said rotary decoding member and said rotor in order allow said coding elements to be driven without interfering with said rotor, while still allowing said rotor to be driven by said rotary decoding member after said spring has been compressed.

The teeth of the rotary decoding member are advantageously chamfered as are the projections on the rotor with which they may come into engagement so that the decoding member is thrust forwardly and looses its engagement with the rotor if the coding elements are not in alignment (the proper combination has not been dialed), and the locking member has thus not released the rotor.

This disposition is particularly advantageous when a fraudulent attempt is made to actuate the rotor prior to dialed the combination.

Such teeth on the rotary decoding member are referred to below as "sliding teeth".

Preferably, the drive members suitable for rotating each of the coding elements are constituted by coding pegs projecting from either side of the mid plane of each of the coding disks.

According to another optional feature of the present invention, said rotary decoding member is provided with structures suitable for coming into driving engagement with the drive means on one of said central disks, regardless of the enclutched or declutched axial position of said central disk, thereby either enabling said lock to be decoded by bringing said notches into alignment, or else enabling its combination to be changed.

The present invention also provides a tool for changing the combination of the above-defined cylinder lock, said tool comprising a needle suitable for entering into said lock to engage said outer rings of said coding elements to prevent them from rotating, and an insert bearing said needle and suitable for declutching said outer rings and said central disks by axial thrust.

In a preferred embodiment of said tool, said insert is provided with an outer thread suitable for engaging in a bore with a complementary tap in order to control the amplitude of relative axial displacement between said outer rings and said central disks during declutching.

BRIEF DESCRIPTION OF THE DRAWINGS

An embodiment of the invention is described by way of example with reference to the accompanying drawings, in which:

FIG. 3 is a partial exploded perspective view of an alternative embodiment of the lock; and FIG. 4 is a partial exploded perspective view of another alternative embodiment of the lock.

Figure 1:
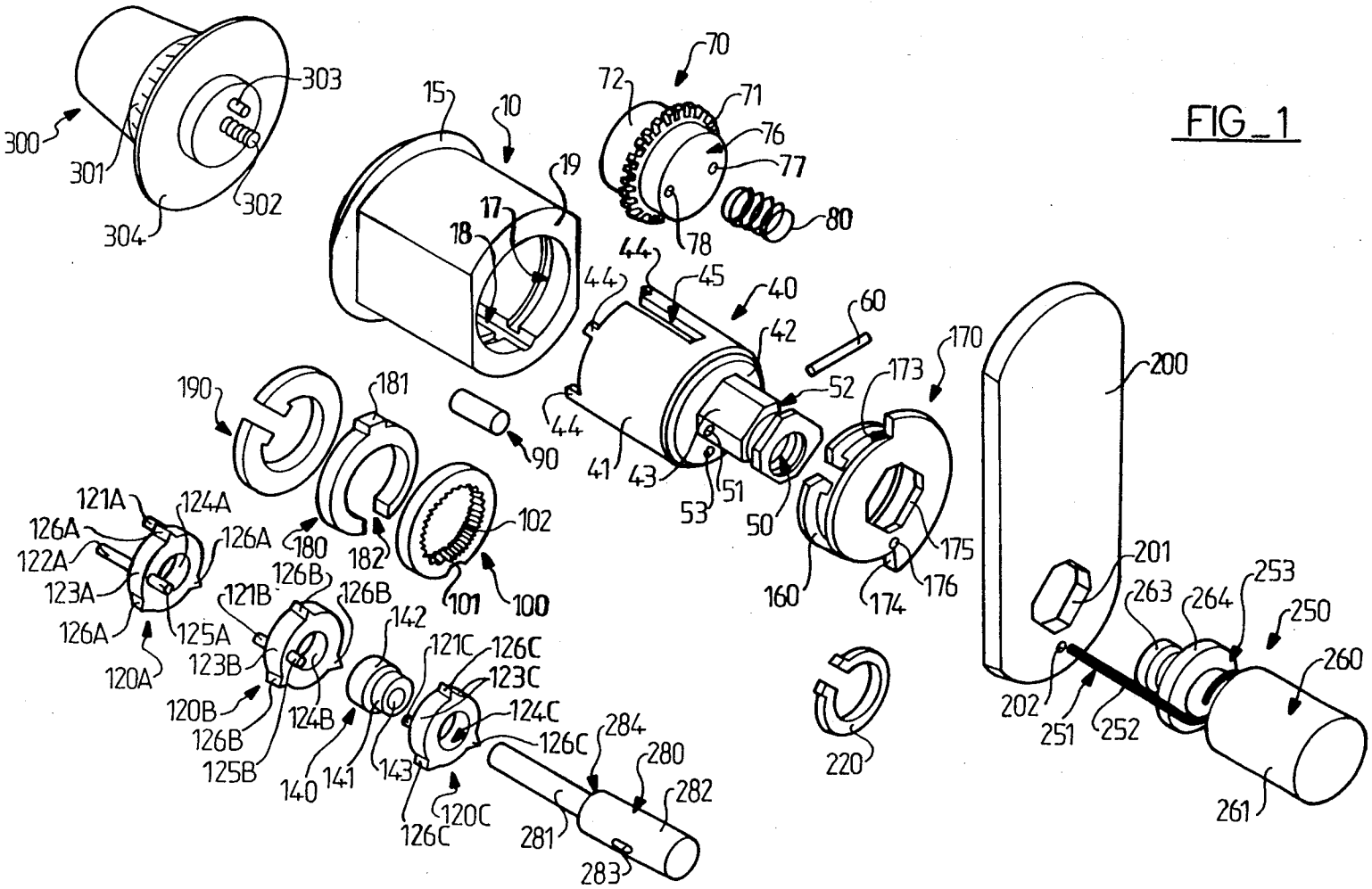
FIG. 1 is a diagrammatic exploded perspective view of a lock in accordance with the invention.

Generally speaking, a lock in accordance with the present invention essentially comprises a stator 10, a rotary decoding element 70, a locking member 90, and a plurality of coding elements each comprising an outer ring 100 in combination with a central disk 120.

Figure 2:
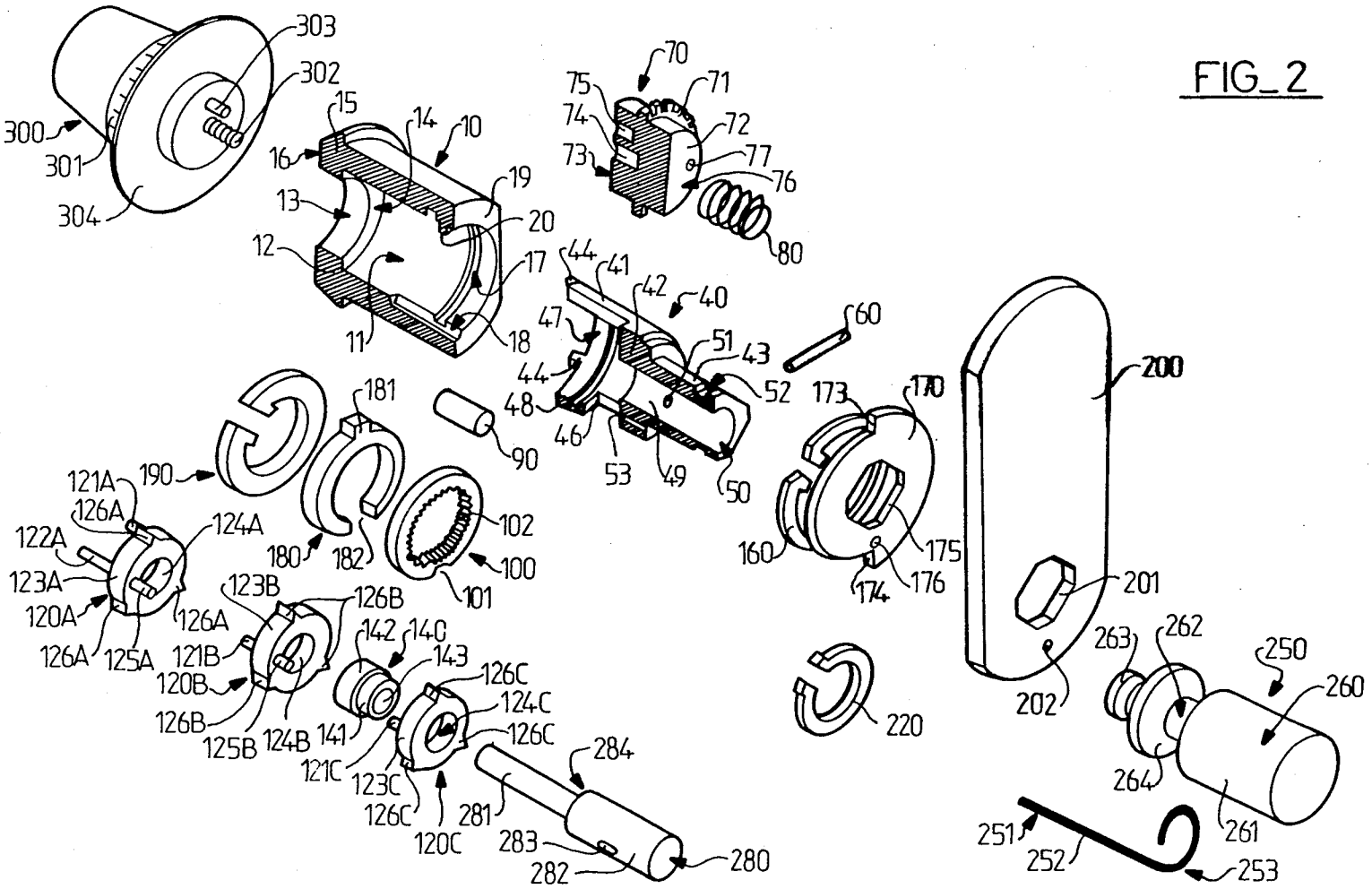
FIG. 2 is a similar view to FIG. 1, but in which the stator, the rotor and the rotary decoding member are drawn in axial section in order to show the internal structure thereof.

This description begins by describing the structural details of each of said component parts of a lock in accordance with the present invention and as shown in FIGS. 1 and 2.

In order to facilitate the description, the "front" face of the lock is the surface of the lock which is accessible to the user (to the left of the figures), and the "back" face of the lock is face fitted with a latch 200 (to the right of the figures).

The stator 10 is generally in the shape of a hollow cylinder defining an internal cylindrical housing 11 of constant cross section and suitable for receiving the rotor 40.

The cylindrical housing 11 has an annular rib 12 at its free front end.

The peripheral inside surface of the ring 12 defines a circular opening 13 at the front of the stator 10 for giving access to the decoding member 70.

The rib 12 also defines an annular bearing surface 14 which extends radially relative to the axis of the cylindrical housing 11 and which faces the back of the stator 10.

Preferably, and as illustrated in the figures, the stator 10 is also provided at its front end with an outwardly directed annular rib 15 for facilitating installation of the lock in a door. The stator 10 advantageously includes a reference mark on its front face 16 or on said rib 15 suitable for co-operating with a graduated scale on a dial 300 and serving as a reference point for dialing the code.

The cylindrical housing 11 opens out to the back of the stator 10.

The cylindrical housing 11 is provided with an annular groove 17 close to its back end and suitable for receiving an inside circlip 160 (or any other functionally equivalent means for holding the rotor 40 inside the cylindrical housing 11 of the stator 10 in front of the circlip 160).

The cylindrical housing 11 also possesses a rectilinear groove 18 which extends longitudinally, i.e. parallel to the axis of the cylindrical housing 11. This groove 18 opens out into the back face 19 of the stator 10.

The groove 18 is suitable for receiving the locking member 90 which is constituted by a cylindrical rod in the present example.

The depth of the groove 18 and the cross-section of the locking member 90 are matched in such a manner as to enable the locking member 90 to be displaced between a locking position in which the locking member 90 prevents relative rotation between the rotor 40 and the stator 10, and a release position (obtained when the notches provided in the peripheries of the rings 100 are aligned) in which the locking member 90 allows the rotor 40 to rotate.

Preferably, the locking member 90 has a diameter equal to twice the thickness of the tubular wall of the rotor 40.

Finally, it may be observed in FIG. 2, that there is an internal projection 20 on the internal periphery of the cylindrical housing 11 and located behind the annular groove 17.

This projection 20 serves as an abutment for a stroke limiter 170.

As diagrammatically illustrated in the figures, the groove 18 intended to receive the locking member 90 is preferably located in the bottom of the stator 10. Thus, the locking member 90 tends to rest under gravity in the bottom of the groove 18 and thus to stay away from the outer rings 100 of the coding elements. This disposition provides a degree of protection against "feeling" the lock given that the locking member 90 only comes into contact with the periphery of the outer rings 100 when an attempt is made to turn the rotor 40, i.e. at a moment when the potential lock picker has no means for turning the coding elements.

The rotor 40 comprises a tubular sleeve 41 which is open towards the front and closed, at least partially, to the back by means of a transverse partition 42.

The rotor 40 extends in the backward direction by means of a elongate structure 43 which is centered on the axis of the tubular sleeve 41 but which does not have circular symmetry about said axis. As shown in the figures, the structure 43 may be polygonal, for example, in a section taken on a plane perpendicular to the axis of the tubular sleeve 41.

The free front edge of the tubular sleeve 41 is provide with a plurality of axially-projecting pegs 44. These pegs 44 are intended to co-operate with a series of teeth 71 extending annularly around the outside periphery of the decoding member 70 like the teeth on a gear wheel.

In order to do this, the angular distribution of the pegs 44 matches the angular distribution of the teeth 71.

Preferably, and as mentioned above, the teeth 71 and the pegs 44 are chamfered.

The tubular sleeve 41 is also provided with two rectilinear slots 45 and 46 which pass through its thickness and which extend longitudinally, i.e. parallel to the axis of the tubular sleeve 41.

The slot 45 extends substantially over the entire length of the tubular sleeve 41.

Preferably the slots 45 and 46 are diammetrically opposite each other about the axis of the tubular sleeve 41.

The bottom slot 46 is intended to receive the locking member 90. The width of the slot 46 is thus not less than the diameter of the locking member 90.

The bottom slot 46 preferably does not open out to the front of the lock, thereby limiting the possible forward travel of the locking member 90.

The top slot 45 is intended to receive a projection 181 from the intermediate rings 180 which are disposed between the various coding rings 100, and whose structure is described in greater detail below. The purpose of engaging the projections 181 in the slot 45 is to prevent the spacer rings 180 from rotating relative to the rotor 40.

The cylindrical internal housing 47 is defined by the tubular sleeve 41 and is suitable for receiving the outer rings 100 and the above-mentioned intermediate or spacer rings 180. The rings 100 and the spacers 180 are fixed inside the cylindrical housing 47 of the rotor 40 by being pressed against the transverse partition 42 of said rotor 40 by an inside circlip 190 (or by any other functionally equivalent means) engaged in an annular groove 48 provided in the internal periphery of the housing 47.

The backward extension 43 and the transverse partition 42 are pierced by a central bore 49 which is partially tapped at its rear end as illustrated diagrammatically at 50.

The extension 43 is also pierced radially by a hole 51 which preferably passes right through it.

The extension 43 has a groove 52 in its outer surface suitable for receiving an outer circlip (or any other functionally equivalent means) suitable for holding the latch 200 on said extension 43.

Finally, the rotor 40 is provided inside its transverse partition 42 with a longitudinal hole 53 passing therethrough and enabling a needle 251 to be inserted into the cylindrical chamber 47 of the rotor 40 from the back of the lock, in order to prevent the rings 100 from rotating.

The above-mentioned stroke limiter 170 is constituted by a generally circular plane plate having two radial bearing surfaces 173 and 174. The stroke limiter 170 has a central opening 175 which is complementary to the cross-section of the extension 43 (which is polygonal in the drawings) in order to prevent any relative rotation between the stroke limiter 170 and the rotor 40.

Finally, the stroke limiter 170 is provided with a bore 176 passing through its thickness and aligned on the longitudinal hole 53 of the rotor 40 and intended to enable the needle 251 to be inserted into the cylindrical housing 47 of the tubular sleeve 41.

The rotary decoding element 70 comprises a cylindrical block 72 having an outwardly directly annulus of teeth 71 on its outer periphery, and there are preferably the same number of teeth as there are graduation 301 on the dial 300.

These teeth 71 are intended to co-operate with the above-mentioned pegs 44 provided on the rotor 40.

The front face 73 of the rotary decoding member 70 is provided with blind holes 74 and 75 for receiving pegs 302 and 303 provided on the dial 300.

Preferably, one of said hole (the bore referenced 74 in the figures) is centered on the front face 73 of the rotary decoding element 70, i.e. is coaxial with the cylindrical block 72, while the other blind hole (75 in the figures) is parallel to the first and is eccentric.

The back face 76 of the rotary decoding member 70 is also provided with blind holes 77 and 78 for receiving pegs 121A and 122A fixed to a coding disk 120A.

Preferably, as shown in the figures, the holes 77 and 78 are diammetricaly opposed about the axis of the cylindrical block 72.

The lock includes three coding rings 100. Only one of these rings has been shown in the figures in order to simplify the illustration.

Each of the rings 100 has a U-section notch 101 opening out to its outer periphery and extending through at least a portion of its thickness. The depth of the notch 101 is equal to one-half of the diameter of the locking member 90.

Further, each ring 100 has structures 102 projecting inwardly from its inside periphery and suitable for co-operating by engaging the outside periphery 123 of the central coding disks 120.

Preferably, the structures 102 are constituted by notches having a triangular or semi-circular or equivalent right cross-section and each ring 100 has as many such notches as there are graduations 301 on the dial 300.

The lock comprises two spacer ring 180 to be disposed between the coding rings 100. As mentioned above, each spacer ring 180 has a projection 181 from its outer periphery suitable for penetrating into the slot 45 in the rotor 40 in order to prevent the spacer rings 180 from rotating relative to the rotor 40.

Further, each spacer ring 180 has a notch 182 suitable for receiving the locking member 90.

The relative positions of the projection 181 and the notch 182 correspond to the relative positions of the slots 45 and 46 on the rotor 40.

As mentioned above, the projection 181 and the notch 182 are preferably diametrically opposite each other.

In the embodiment illustrated in the figures, the notch 182 passes right through the spacer ring 180 such that each spacer ring is in the form of an open or C-shaped ring.

The lock also includes a rod 280 which constitutes the declutching member and which is adapted to support the central disks 120 together with the spacers 140 which are associated therewith.

As can be seen in the accompanying figures, the rod 280 comprises two coaxial cylindrical portions 281 and 282 of different diameters. The cylindrical section 281 is of smaller diameter and is located in front of the cylindrical section 282.

The rear cylindrical section 282 which is of larger diameter is provided with an opening 283 which passes transversly through the rod 280.

The outside diameter of the cylindrical section 282 is complementary to the bore 49 of the rotor 40 and the axial position of the opening 283 in said section 282 is located in such a manner that the opening 283 lies opposite to the orifice 51 through the rotor 40 in order to receive a pin 60 engaged through the orifice 51.

The longitudinal extent (parallel to the axis of the rod 280) of the opening 283 is greater than the diameter of the pin 60 whereas its transverse extent is substantially equal to the diameter of the pin 60 so that inserting the pin 60 through the orifice 51 and through the opening 283 prevents the rod 280 from rotating relative to the rotor 40 and limits the allowable axial stroke thereof.

The junction between the two cylindrical sections 281 and 282 defines an annular bearing surface 284 which faces forwards and which serves as an abutment for the spacers 140.

The lock includes three spacers 140.

In order to simplify the illustration, only one of these spacers is shown in the accompanying figures.

Each of the spacers 140 comprises a stepped ring.

That is to say each spacer 140 comprises two coaxial cylindrical portions 141 and 142 of different diameters, and includes a common central cylindrical bore 143.

The inside diameter of the internal bore 143 fits the outside diameter of the smaller diameter section 281 of the rod 280.

The outside diameter of the smaller of the two sections of a spacer 140 fits the inside diameter of the bores 124 provided through the center of each of the coding disks 120 and serves as a rotary bearing therefor.

The outer diameter of the larger section 142 of each spacer 140 is less than the diameter at which the drive pegs 121, 122 and 125 are provided projecting axially from the coding disks 120.

The lock includes three coding disks 120. In the figures, indices A, B, and C relate to each of these disks respectively.

The three disks 120A, 120B, and 120C have a common central bore 124 which is complementary to the smaller section portion 141 of the spacers 140 and they also have structures 126 around their outer peripheries suitable for co-operating with the structure 102 of the coding rings 100 by engaging them in a multiplicity of predetermined angular positions.

As shown in the accompanying drawings, the structures 126 provided on the outer periphery of each coding disk 120 comprise teeth (e.g. three teeth per disk) which are at regular angular intervals of 120° and which are suitable for penetrating into the structures 102 of the coding rings 100.

The disks 120A, 120B, 120C, have different numbers of drive pegs.

As shown in the accompanying drawings, the various pegs are cylindrical in shape and extend transversly from the coding disks 120.

However, and preferably, these pegs are constituted by a ring sector equal to one graduation 301 of the dial 300 and defining two bearing surfaces which are radially oriented relative to the axis of the coding disks 120.

The foremost coding disk 120A has two pegs 121A and 122A on its front face suitable for entering the holes 77 and 78 of the rotary decoding member 70 and capable of sliding axially relative thereto.

The lengths of the pegs 121A and 122A and the lengths of the blind holes 77 and 78 are determined in such a manner that these items continue to co-operate throughout axial displacement of the coding disk 120A over a stroke which is slightly greater than the thickness of the coding rings 100. In other words, the pegs 121A and 122A together with the blind holes 77 and 78 are suitable for ensuring co-operation between said elements regardless of the axial position of the coding disk 120A and the associated coding ring 100, thereby making it possible either to decode the lock by aligning the notches 101, or else to declutch the coding disks 120 from the coding rings 100 and thus change the combination of the lock.

The foremost disk 120A also includes a peg 125 on its rear face which is adapted to drive the middle disk 120B by coming into contact with one or other of the sides of a peg 121B provided on the front face of the middle disk. Similarly, the middle disk 120B has a rearwardly directed peg 125B capable of rotating the rearmost disk 120C by coming into contact with one or other side of a forwardly projecting peg 121C provided on the front face of the rear disk 120C.

It will be observed that the disk 120C has only one peg 121C and that that peg is disposed on its front face.

Preferably, the pegs 122A and 125A are aligned, as are the pegs 121B and 125B.

The graduated dial 300 for co-operating with the rotary decoding member 70 has two pegs 302 and 303 for penetrating into respective ones of the blind holes 74 and 75.

The positions of the pegs 302 and 303 on the dial 300 are naturally complementary to the positions of the blind holes 74 and 75 on the rotary decoding member 70.

Advantageously, one of the pegs 302 is centered and serves as a guide by penetrating into the blind hole 74, whereas the other peg 303 is eccentric, and is shorter, thereby serving to drive the rotary decoding member 70 after it has penetrated into the blind hole 75.

The dial 300 may be removable.

However, in a variant and as shown in the figures, the central peg 302 may be constituted by a screw which is engaged in the dial 300 and which is adapted to be engaged in the blind hole 74 which is correspondingly tapped in order to fix the dial 300 to the lock.

Penetration of the dial 300 into the lock is limited by an annular collar 304.

The spacers 140 are constrained to rotate with the rod 280 by any suitable conventional means, e.g. by being crimped thereto.

The helical spring 80 is inserted between the rotary decoding member 70 and the rod 280 after it has been fitted with the spacers 140 and the coding disks 120.

The spring 80 bears firstly against the cylindrical block 72 of the rotary decoding member 70 and secondly against the front face of the spacer 140A so as to urge the rotary decoding member 70 forwardly in the lock and to urge the assembly constituted by the rod 280, the spacers 140, and the coding disks 120 backwardly therein.

The latch 200 in the accompanying figures is constituted by an oblong plate having an opening 201 passing through the plate near one end thereof and being complementary in cross-section to the polygonal extension 43.

The latch 200 also includes a bore 202 passing therethrough and intended to come opposite the bore 176 through the limiter 170 and the hole 53 through the rotor 40 in order to enable the needle 251 to be inserted into the lock to prevent the coding rings 100 from rotating.

The structure is now described of a combination-changing tool 250 which is shown diagrammatically to the right in the figures.

This combination-changing tool 250 comprises the combination of a needle 251 and an insert 260 which are shown separate in FIG. 2 in order to clearly illustrate the structure of each of these two components.

In the embodiment shown in the figures, the insert 260 comprises a cylindrical sleeve 261 to be gripped by the user, which sleeve extends forwardly in the form of a coaxial rod 262 which is threaded at its front end (reference 263) and which is provided behind the thread 263 with an annular flange 274.

The needle 251 comprises a rigid rectilinear length 252 which terminates at its rear end with a turn wound round the rod 262 of the insert 260.

The turn 253 of the needle 251 around the rod 262 is adapted to allow relative rotation between the needle 251 and the insert 260.

The threaded front end 263 of the rod 262 is adapted to engage with the tapped bore 50 of the rotor 40 so as to thrust the rod 280 together with the spacers 140 and the coding disks 120 in a forward direction, thereby declutching the coding disks 120 from the coding rings 100 in a manner which is described in greater detail below.

The thicknesses of the spacer rings 180 and of the portions 142 of the spacers 140 are equal to one another, as are the thickensses of the coding rings 100 and the coding disks 120.

Further, the thicknesses of the spacer rings 180 and 142 are greater than the thicknesses of the coding rings 100 and the coding disks 120 and are slightly greater than the stroke allowed to the rod 280 when moving in axial translation inside the rotor 40.

The key-less combination cylinder lock described in detail above is assembled as follows.

Firstly, the three coding disks 120 and the three spacers 140 are disposed on the smaller diameter portion 281 of the declutching rod 280. More precisely, the disk 120C, a spacer 140, the disk 120B, a second spacer 140, the disk 120A, and finally a third spacer 140 are threaded in succession onto the portion 281.

The rod 280 together with the coding disks 120 and the spacers 140 constitute, once the spacers 140 have been fixed, e.g. by crimping or by screwing, a self-contained sub-assembly in which all the parts of the sub-assembly move together in axial translation, and in which only the coding disks 120 are free to rotate relative to the rest of the sub-assembly.

At the same time, three coding rings 100 and two spacer rings 180 are engaged in the cylindrical housing 47 of the rotor 40 and are fixed axially by means of an internal circlip 190.

The rotor 40, the three coding rings 100, the two spacer rings 180, and the internal circlip 190 then constitute a self-contained sub-assembly in which all the parts move together in axial translation, and in which only the coding rings 100 are free to rotate relative to the remainder of the sub-assembly and provided they are not held in position by the needle 252. The spacer rings 180 are prevented from rotating relative to the rotor 40 by virtue of their projections 181 which are engaged in the slot 45.

The rod fitted with the coding disks 120 and the spacers 140 is inserted into the rotor 40 from the front.

The larger diameter cylindrical portion 282 penetrated into the bore 49 and the coding disks 120 engage the coding rings 100 by virtue of the structures 126 and 102 meshing.

The rotary decoding member 70 is inserted from the rear into the stator 10 followed by the helical spring 80.

The locking member 90 is engaged in the groove 18 in the stator 10.

Finally, the notches 101 in the coding rings 100 are aligned and the rotor 40 together with the coding rings 100, the coding disks 120 and the rod 280 is engaged into the stator 10 from the rear thereof and is fixed therein by means of the internal circlip 160 engaged in the groove 17.

Finally, the stroke limiter 170 and the latch 200 are engaged by means of the openings 175 and 201 onto the extension 43 and are fixed thereto by means of the outer circlip 220.

The lock is then ready for use.

The general operation of such a key-less combination lock is already described in European patent application No. 0088012 and is not fully described below.

In summary, the lock is opened by rotating the rotor 40 in the stator 10. This is initially prevented by the locking member 90 being engaged in the groove 18 and in the slot 46 and thus preventing the rotor 40 from rotating relative to the stator 10.

In order to allow the rotor 40 to rotate, it is necessary for the locking member 90 to penetrate into the notches 101 of the coding rings 100 and also into the notches 182 in the spacer rings 180 so that the locking member 90 leaves the longitudinal groove 18 provided in the stator 10.

The notches 101 are aligned by rotating the rotary decoder member 70 and by fixing the angle of rotation thereof by means of the graduations 301 provided on the dial 300 in conjunction with the index mark provided on the front face 16 of the stator 10.

The decoding process by means of the rotary member 70 for aligning the notches 101 is well known, per se, to the person skilled in the art and is not explained below.

Detailed descriptions of the appropriate decoding operations are to be found in German Pat. No. 28 656 and in the Applicant's French patent application published under the No. 2 522 352.

There follows a description of the process for changing the combination of a lock in accordance with the present invention.

The general principle of this declutching process lies in the possibility of relative axial translation between the coding disks and the coding rings 100 enabling the relative positions of the notches 101 and the drive pegs 121 and 125 to be changed for each of the coding elements constituted by the combination of one of the coding rings 100 and one of the coding disks 120.

In other words, automatic combination changing is made possible by each coding element being divided into a ring 100 and a disk 120 capable of rotating relative to each other, with one of said components having a notch 101 for receiving the locking member 90, and the other having the drive pegs 121, 125.

The combination is changed by performing the following operations in order:

(1) the old combination is dialed by turning the rotary decoding member 70 so as to align the various notches 101 on the coding rings 100 over the locking member 90;

(2) the needle 251 is inserted through the orifices 202, 176 and 53 to prevent the coding rings 100 from rotating, and the threaded rod 263 is screwed into the tapped bore 50 in order to thrust the rod 280 together with its coding disks 120 in a forwards direction, thereby declutching the coding disks 120 from the coding rings 100;

(3) the new code is dialed by means of the rotary decoding member 70 (and it should be observed that regardless of the axial displacement provoked by the insert 260, the pegs 121A and 122A of the disk 120A always co-operate with the member 70); with the newly-dialed code causing relative rotation between the drive pegs 121, 125 on the coding disks and the notches 101 on the associated coding rings, since the coding disks 120 are declutched from the rings 100 and are situated level with the spacers 180;

(4) finally, the threaded rod 263 is unscrewed in order to remove the insert 260 and the needle 251.

The lock is then ready for use, together with its new combination.

It should be observed that the structure of the combination-changing tool 250 as described above serves to hold the needle 251 against rotation while the insert 260 is turned in order to engage the threaded rod 263 in the tapped bore 50.

The spring 80 located between the rotary decoding member 70 and the declutching rod 280 serves either to enable the assembly constituted by the rod 280, the disks 120 and the spacers 140 to move forwardly from their normal rearward position in order to change the combination, or else to allow the rotary decoding member 70 to be pushed in after the code has been dialed in order to put it into engagement with the rotor 40 (by means of the teeth 71 and the pegs 44) in order to rotate the rotor 40 and the latch 200.

It may also be observed, and this is an important feature, that by virtue of the structure shown in the above-described figures, there is never any need to open the lock, i.e. to rotate the rotor 40, while changing the code.

Naturally the present invention is not limited to the particular embodiment which has been described above, but extends to any variant thereof lying within the scope of the claims.

For example, the above-described structure allows the disks 120 and the rings 100 to be declutched by means of forwardly directed axial translation of a rod 280 bearing the disks 120, however the structure shown in the figures could easily be adapted by the person skilled in the art to enable equivalent declutching to be obtained by rearwardly directed axial translation.

In the example shown in the figures, the rotary decoding member 70 is urged away from the rotor 40 by the spring 80 and remains constantly engaged with the coding disk 120A. As a result the rotary decoding member 70 must be displaced axially after the combination has been dialed in order to bring the rotary decoding member 70 into engagement with the rotor 40 by compressing the spring 80.

In a variant, a structure could be designed in which the rotary decoding number 70 is constantly urged into engagement with the rotor 40.

In this case, it becomes necessary to begin by moving the rotary decoding member 70 away from the rotor 40 before dialing the combination.

In another variant, the rotary decoding member 70 shown in the figures, which co-operates both with the coding disks 120 and also with the rotor 40, could be replaced by two separate items one of which would co-operate with the coding disks 120 and the other with the rotor 40. Naturally, in such a case, the item which co-operates with the rotor 40 can only be rotated after the appropriate combination has been dialed, i.e. after the notches 101 in the coding rings 100 have been aligned to receive the locking member 90.

In yet another variant embodiment as shown in FIG. 3, the rod 280 shown in the figures and provided with a slot 283 could be replaced by a similar rod having two transverse holes 283A and 283B passing therethrough, each intended to receive the pin 60. In this case the combination of the lock is changed as follows: dial the old combination, insert a needle into the hole 53 in the rotor 40, remove the pin 60, push home the rod 280 to declutch the disks 120, replace the pin 60 through the second hole 283B in the rod to fix the disks 120 in the de-clutched axial position, dial the new combination, remove the pin 60 to allow the rod 280 to return to the normal operating position, reinsert the pin 60 to the initial hole 283B, and remove the needle which is preventing the coding rings 100 from rotating.

The advantage of this embodiment is that under normal conditions it fixes the rod 280 in a rearward position, thereby preventing any unwanted declutching, and similarly during combination changing it fixes the rod in a forward position thereby preventing any unwanted enclutching.

Preferably, this particular embodiment has the rod 280 projecting through the back of the rotor 40, in use, by an amount equal to its forward stroke as required for declutching the coding disks 120, thereby facilitating axial positioning of the rod 280 in the rotor 40.

In yet another variant, the rod 282A may be of polygonal cross-section as shown in FIG. 4, and be free to move in axial translation while being prevented from rotating in a semi-blind complementary bore 49A in the rotor.

In another embodiment, the combination may be changed by the following sequence of operations:

dialing the old code in order to align the notches 101 of the coding rings 100;

rotating the rotor 40 and fixing the latch 200 in a precise angular precision to simultaneously lock the rotor 40 and the coding rings 100 by means of the locking member 90;

displacing the rod 280 axially to declutch the coding disks 120;

dialing the new code by disengaging the rotary decoding member 70 and the rotor 40 and then by controlling the coding disks 120;

releasing the rod 280 so that it moves backwards to re-engage the coding disks 120 in the associated coding rings 100.

However, it may be observed that in this last variant it is necessary to have two index marks on the front face of the stator 10 which are relatively inclined depending on the angle between the latch in its closure position and the angle selected for setting up new combinations.

The openings 175 and 201 provided in the stroke limiter 70 and the latch 200 may be of shapes other than those shown in the figures, for example they may be of square section and, where applicable, the bores 176 and 202 could be omitted, with the needle then passing through one of the angles of the openings 175 and 201.

I claim:

1. A lock operable by a combination comprising:

a stator having a cavity;

a rotor rotatably mounted within said cavity of said stator;

a latch mounted to said rotor;

at least one locking member interposed said rotor and said stator, said at least one locking member slidable between a locking position in which said rotor is fixed relative to said stator and a release position in which said rotor may be rotated relative to said stator;

a declutching member slidably mounted to said rotor for axial movement between an enclutching position and a declutching position;

a plurality of coaxial coding elements mounted within said rotor, each of said plurality of coding elements having an outer ring and a concentric central disk, said outer ring having an outside peripheral portion, said outside peripheral portion having a notch for receiving said locking member, said central disk having means for rotatably driving an adjacent coding element when said central disk is rotated, said central disk further having a circumferential edge portion adapted to be received within said outer ring in a multiplicity of predetermined relative angular positions, said central disk mounted to said declutching member for axial movement when said declutching member is moved between said enclutching position and said declutching position;

a rotary element decoding member mounted within said stator having means for rotating one of said plurality of coding elements to bring said notch of said outer ring of each of said plurality of coding elements into alignment to accept said locking element in said release position;

at least one first spacer disposed between each said outer ring of said plurality of coding members, and between said decoding member and one outer ring of said plurality coding members, each of said at least one first spacer establishing a predetermined axial gap between said outer ring such that, when said central disks are in said declutching position, each central disk is rotatably positioned in each said axial gap and rotatable relative to its respective outer ring when said declutching member and each said central disk are in said declutching position for changing the combination of the lock.

2. The lock according to claim 1, further comprising: a retaining member and said rotor further comprises a passage suitable for enabling said retaining member to be inserted into said lock, said retaining member being suitable for engaging said outer rings to prevent rotation thereof prior to declutching said central disks and said outer rings.

3. The lock according to claim 1, wherein said declutching member comprises a rod suitable for axial displacement within said lock by virtue of said central disks being provided with respective central bores, and wherein said central disks are free to rotate relative to said rod while being prevented from axial displacement relative thereto.

4. The lock according to claim 3, further comprising said at least one second spacer member fixing the axial positions of said central disks along said rod, each said at least one second spacer engaging said rod between said central disks in such a manner as to be caused to rotate with said rod.

5. The lock according to claim 4, wherein each of said at least one second spacer comprising a first and second stepped ring, said first stepped ring having a smaller first predetermined cross section being engaged in said central bore through said central disk and constituting rotary bearings therefor, said second stepped ring having a greater cross section for preventing relative axial displacement between said central disks and said rod.

6. The lock according to claim 4, wherein said rod, said at least one second spacer, and said central disk comprise a subassembly in which all the parts of said subassembly are prevented from relative axial displacement, and in which only said central disks are free to rotate relative to said subassembly.

7. The lock according to claim 1, wherein said rotor defines a generally cylindrical housing in which said outer ring of each of said plurality of coding elements is engaged in such a manner as to be free to rotate while being prevented from relative axial displacement by said at least one first spacer.

8. The lock according to claim 1, wherein said rotor, said outer ring of each of said plurality coding elements and each of said at least one first spacer associated with said outer rings comprise a second subassembly which is constrained to move in the axial direction and in which only said outer ring of each of said plurality coding elements is free to rotate.

9. The lock according to claim 8, wherein said declutching member comprises a rod suitable for axial displacement within said lock and wherein a first axial thickness of each of said at least one second spacer is greater than a second axial thickness of said outer ring and of said central disk of said plurality of coding elements, and at least slightly greater than a stroke of said rod moving between said enclutching position and said declutching position.

10. The lock according to claim 1, wherein said declutching member comprises a rod suitable for axial displacement within said lock, and wherein said rod has a through slot for receiving a pin engaged in said rotor, thereby preventing said rod from rotating relative to said rotor and limiting said stroke relative thereto.

11. The lock according to claim 1, wherein said declutching member comprises a rod suitable for axial displacement within said lock, and wherein said rod has two transverse bores each of which is suitable for receiving a removable pin engaged in said rotor, thereby constraining said rod to rotate with said rotor and defining two axial positions of said rod relative to said rotor, said positions corresponding to said outer rings and said central disks of said coding elements being enclutched and being declutched, respectively.

12. The lock according to claim 1, wherein said declutching member comprises a rod of polygonal cross section which is free to move axially but which is not free to rotate in a complementary half-blind hole provided in said rotor and co-operating with a screw engaged in said bore to displace said rod axially.

13. The lock according to claim 1, wherein said rotary decoding member is axially displaceable to rotate said rotor and to open said lock when said notches in said outer rings are in alignment.

14. The lock according to claim 13, wherein said rotary decoding member is constituted by a cylinder having sliding teeth suitable for engaging said rotor in order to rotate said rotor when said notches are in alignment.

15. The lock according to claim 1, wherein said rotary decoding member is disposed on front face of said stator and having a portion suitable for co-operating in driving relationship with a dial, said dial and said stator having graduations and a reference point capable of indicating the relative angular position of said dial and said stator.

16. The lock according to claim 1, wherein said rotary decoding member is provided with a structure suitable for driving engagement with said drive means of one of said central disks, in both said enclutched and said declutched axial positions of said central disk, thereby enabling said lock to be decoded by bringing said notches into alignment and enabling the combination to be changed.

17. The lock according to claim 1, wherein a spring is disposed between said rotary decoding member and said declutching member to initially separate said rotary decoding member and said rotor in order to allow said plurality of coding elements to be driven without interfering with said rotor, while still allowing said rotor to be driven by said rotary decoding member after said spring has been compressed.

18. The lock according to claim 1, further comprising a tool having a needle suitable for entering into said lock to engage said outer ring of each of said plurality of coding elements to prevent rotation, and an insert member bearing said needle, said insert member suitable for declutching each said outer ring and said central disk of said plurality of coding elements by axial thrust.

19. The lock according to claim 18, wherein said insert member further comprises an outer thread suitable for engaging in a bore with a complementary tap in order to control the amplitude of relative axial displacement between said outer rings and said central disks during declutching.

* * * * *